US007766190B2

(12) United States Patent
Chen

(10) Patent No.: US 7,766,190 B2
(45) Date of Patent: Aug. 3, 2010

(54) SEALED CRIMP TUBE WITH STIFFENER

(76) Inventor: Fang-Pin Chen, No. 18 Cheng Gong Street, Min-Shyong Industrial Park, Chia-Yi Hsien (TW)

( * ) Notice: Subject to any disclaimer, the term of this patent is extended or adjusted under 35 U.S.C. 154(b) by 426 days.

(21) Appl. No.: 11/824,040

(22) Filed: Jun. 29, 2007

(65) Prior Publication Data

US 2009/0001098 A1 Jan. 1, 2009

(51) Int. Cl.
*B65D 35/00* (2006.01)

(52) U.S. Cl. ..... 222/107; 222/92; 222/206; 222/209; 222/215

(58) Field of Classification Search ..... 222/105, 222/107, 92, 214, 215, 206, 209
See application file for complete search history.

(56) References Cited

U.S. PATENT DOCUMENTS

| | | | | |
|---|---|---|---|---|
| 523,254 | A | 7/1894 | Winkley | |
| 962,902 | A | 6/1910 | King | |
| 2,596,592 | A | 5/1952 | Parker | |
| 3,939,887 | A | 2/1976 | Scarnato | |
| 4,535,581 | A | 8/1985 | Fujiki et al. | |
| 4,821,924 | A | 4/1989 | Kozam | |
| 5,348,194 | A | 9/1994 | Mascitelli et al. | |
| 5,454,486 | A * | 10/1995 | Mack et al. | 222/95 |
| 5,529,213 | A * | 6/1996 | Mack et al. | 222/95 |
| 5,615,791 | A | 4/1997 | Vatelot et al. | |
| 6,305,577 | B1 * | 10/2001 | Fillmore et al. | 222/95 |
| 6,572,296 | B2 | 6/2003 | Schrpf | |
| 6,691,472 | B2 | 2/2004 | Hubert | |
| 6,923,347 | B2 | 8/2005 | Winckels | |
| 2003/0183639 | A1 * | 10/2003 | Winckels | 220/666 |
| 2004/0076786 | A1 | 4/2004 | Naipawer et al. | |
| 2004/0173558 | A1 * | 9/2004 | Chen | 215/12.1 |
| 2006/0240252 | A1 | 10/2006 | Takahashi et al. | |

FOREIGN PATENT DOCUMENTS

| | | | |
|---|---|---|---|
| EP | 0210052 | * | 1/1987 |
| JP | 07-292335 A | | 7/1995 |

* cited by examiner

*Primary Examiner*—Kevin P Shaver
*Assistant Examiner*—Donnell Long
(74) *Attorney, Agent, or Firm*—Dennis A. Gross; The Hill Firm

(57) ABSTRACT

A crimp tube having a sealed throat opening at one end and an open end crimped close at an opposite end is provided with an internal stiffener which is resilient and will return to its original shape upon release of pressure. The stiffener is generally cylindrical and has generally radial openings therethrough communicating to the space between the outer diameter of the stiffener and the inner diameter of the tube to allow contents to flow to the interior of the stiffener and from the interior of the stiffener to the area between the stiffener and the inner diameter of the tube. The tube being formed of soft material is collapsible against the stiffener and further collapsible with the stiffener to dispense materials from the tube subsequent to opening the closure at the throat. On release of pressure the stiffener will return to its uncompressed condition.

8 Claims, 3 Drawing Sheets

SEALED CRIMP TUBE WITH STIFFENER

FIELD OF THE INVENTION

This invention relates to containers and more particularly to soft metal crimped tube containers.

BACKGROUND OF THE INVENTION

Crimped tube containers are widely known and generally consist of a main tubular body member for holding contents having a restricting neck to a smaller diameter throat leading to an open dispensing first end at one end of the main body member and a larger open second end at the opposite end of the main body. The main body is generally tubular, but may be other shapes, and the second end is normally used for filling the tubes with product. Thereafter the tube's filling end is generally closed by crimping. Where the body member is made of plastic the crimping may include heat sealing or other known plastic bonding processes to close the open filling end.

However, a class of such containers is made of soft metal such as aluminum which is particularly desirable for certain products, including those types of products which benefit from protection against moisture, air contact, UV exposure and the like.

As described in my previously published application 2004/0173558, the contents of which are herein incorporated by reference, such metal tubes are particularly applicable for use with adhesives such as cyanoacrylates. In such instances the mouth opening is generally closed off with a pierceable membrane formed in the throat of the tube, and the cyanoacrylate product is filled from the opposite open end. Such filling may be under controlled atmosphere conditions and may, in certain instances, be made in the presence of inert gasses.

Such soft metal tubes have been used for cyanoacrylate for many years and after filling are crimped closed in the normal manner, which usually includes both a folding and a mashing or crimping operation at the tube filling open end.

While such tubes are particularly useful for materials such as cyanoacrylates, which can then be dispensed in somewhat controlled quantities by piercing the membrane closure and then controllably squeezing the tube, due to the softness and the yieldability of the tube accurate dispense pressure is difficult to maintain, and more importantly, the tube tends to remain in its squeezed state and will not return to its original dimensions. This of course results in the inability to continue dispensing when the area being pressed becomes fully collapsed or when the material remaining in the tube is below the area in which pressure is applied and a compressed area of the tube blocks flow to the mouth.

This problem has long been recognized and in general such tubes are simply rolled up from the crimped end as the contents are dispensed so that the area above the rolled up end is generally retained in its original uncompressed state, or something close thereto, and can be squeezed to provide a somewhat controlled dispense. While such tubes have utility, their failure to be able to return to something approaching the pre-squeezed state so as to avoid the necessity of rolling up the bottom is a disadvantage, and their inability to suck back material from the neck or mouth area or from a dispensing nozzle affixed to a mouth presents an undesired limitation. This has led to the use of formed metal tubes for dispensing materials such as cyanoacrylates. As described in U.S. Pat. Nos. 5,799,829 and 6,726,060, the use of non-crushable metal tubes for dispensing cyanoacrylates can provide a sniff back or material drawback function when the squeezing pressure against the walls of the metal tube is released and the tube returns to its pre-squeezed condition while overcoming the disadvantages of crimped soft metal tubes but at a much greater expense.

As explained in my prior published application, somewhat the same advantage can be obtained in a crimp tube by providing an internal stiffener which may, for example, be formed of a material impervious to the crimp tube's contents but having a stiffness and resiliency sufficient to return the soft metal tube to its original shape when the external squeezing force is released. As shown in that application, this can be accomplished by internally positioned tubes having an outer diameter substantially equal to the normal inner diameter of the crimp tube when in its fully shaped condition.

In my earlier application I also described providing openings or cutouts through the inner tube to assist the inner tube in returning to its normal shape after squeezing.

While such inner tubes or stiffeners both provide for more accurate control of dispensing in that they provide a resistance to squeezing of the tube greater than would be provided by the soft metal of the tube itself, and also can provide for a sniff back into the main body of material dispensed into an applicator tip or the like, certain disadvantages have been identified, which, in part, have led to such internal tube stiffened soft metal crimp tubes not being accepted in the industry. Among the disadvantages are the fact that the internal stiffening tube, having a diameter the same as the normal maximum inner diameter of the metal tube, can chafe against the metal tube interior, particularly at the ends of the stiffener and can provide pressure points that may lead to a failure of the integrity of the soft metal crimp tube. Additionally, the contents of the tube will find its way into the area surrounding the stiffener tube when the stiffener tube is being compressed during a dispense cycle and the contents are free to flow through the openings or cutouts into the area between the inner stiffener tube and the outer soft metal tube. As the inner tube thereafter is allowed to return to its normal shape, that material can either become trapped between the stiffener tube and the soft metal tube or can flow back through the opening at a rate which may adversely impact the drawback or sniff back capability.

It would therefore be an improvement in the field of such soft metal crimp tube containers to provide a squeeze resistant stiffener which did not have the disadvantages described.

SUMMARY OF THE INVENTION

In accordance with the present invention there is provided a soft metal crimp tube container body consisting of a generally cylindrical contents storing main body container section closed at one end by a smaller diameter throat leading to a dispensing mouth opening, the throat containing a pierceable membrane, the main body closed at the other end by a standard crimp closure, the container is provided with an internal, preferably plastic material, stiffener which is yieldable and resilient and which has an outer diameter less than the inner diameter of the crimp tube. The stiffener is provided with passageways communicating the interior of the stiffener to the exterior of the stiffener and into the area between the interior of the crimp tube wall and the exterior wall of the stiffener. Such passageways ideally constitute a relatively large percentage of the surface area of the stiffener, preferably in excess of 20% but not such a large area as to adversely effect the resiliency of the stiffener or to require the use of a thick walled stiffener.

In an embodiment of the invention the soft metal crimp tube has a main body portion extending from a thicker material dispensing throat opening at one end to a diameter reducing area at the other end which terminates in a rolled or folded and crimped closure. The main body portion preferably is circular in cross section. An internally positioned stiffener, preferably formed of plastic, is received inside of the main body portion and has an outer diameter less than an inner diameter of the main body portion and preferably an axial length less than the distance between the throat and the diameter reduction leading to the crimped end. In an embodiment the internal stiffener is itself tubular having longitudinal slots circumferentially spaced apart and extending substantially the greater part of the length of the stiffener. The slots provide individual ribs between the slots and the ribs are preferably elastic and resilient.

In an embodiment of this invention the internal stiffener is tubular and is provided with a series of both circumferentially and axially spaced holes or openings therethrough from the stiffener interior to the stiffener exterior. The openings may extend around the periphery of the tube or lie only in certain areas of the tube.

In an embodiment of the invention the internal stiffener is formed as an open coil which is radially resilient.

In all embodiments the internal stiffener provides resistance to collapse of the soft metal tube under dispensing pressure while itself collapsing or yielding and will upon removal of dispensing pressure re-expand to its original shape pushing the outer tube outwardly back towards its original shape thus creating an internal negative pressure which may be utilized to suck a portion of dispense material back into the tube.

Because the internal stiffener is of a smaller exterior than the normal interior space of the tube, it is free to "float" within the tube when the tube is in its fully expanded normal condition. As the tube is used, since the stiffener will not return the compressed portions of the tube to their full dimension, portions of the stiffener may remain in contact with interior wall portions of the crimp tube.

Other objects, advantages and features of the invention will become apparent from the following detailed description when taken in conjunction with the accompanying drawings.

DESCRIPTION OF THE PREFERRED EMBODIMENTS

Figure 1:
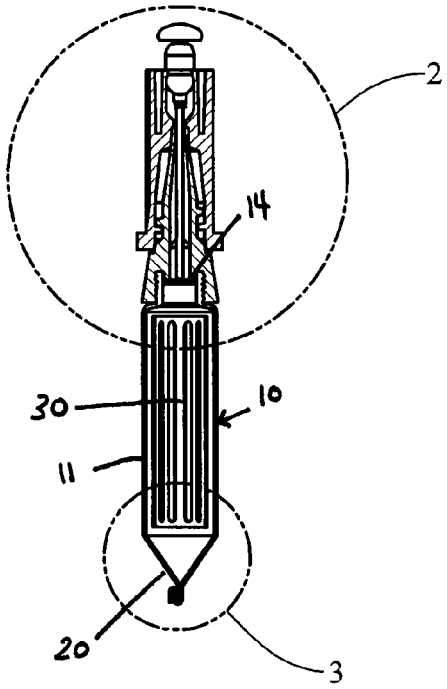
FIG. 1 is a cross sectional view of a crimp tube according to this invention.

FIG. 1 illustrates a container 10 having a relatively thin walled main body portion 11 topped at a neck portion 12 which communicates to a throat 13 which terminates in an open mouth 14. The throat 13 may be formed of a thicker body of material than the main body 11 and may be closed by a membrane or diaphragm 16 formed integrally with the body 10 or applied over the top of the mouth as the case may be, both alternatives being well known to those of ordinary skill in the art.

Figure 3:
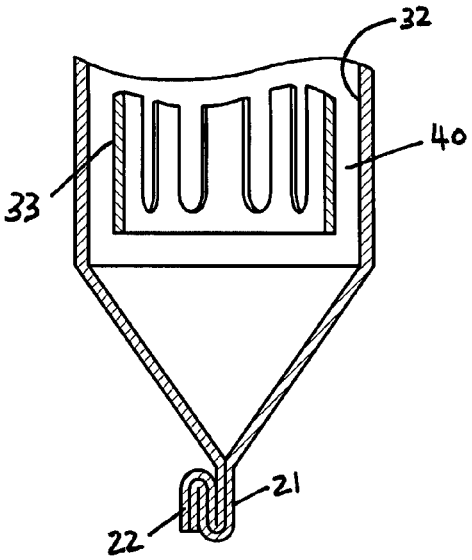
FIG. 3 is an expanded cross sectional view of the area identified as 3 in FIG. 1.

The body 10 is formed of a soft crushable metal such as aluminum alloy and as is common in the art, the bottom 20 of the main body 11 will normally be left open and used for filling the contents of the main body. After filling, the bottom 20 is closed by a crimping 21 which may formed by a number of known standard of closure means, but which generally include flattening of the soft metal tube at the end thereby forming two opposed sides brought together. The flattened section may then be folded either in an S fold as illustrates at 22 in FIG. 3 or in an overlap fold where the first fold is folded further over upon itself. Thereafter the folded section is usually mashed together or crimped to provide a seal at the bottom of the tube.

The throat portion 13 may be threaded on its exterior 23 to receive a cap 24 which may include a dispensing nozzle 25. The cap may also be equipped with a piercing pin overcap 26, for example, of the type found in U.S. Pat. No. 6,726,060. The particular type of cap employed with the container of this invention may alternatively be selected from amongst a wide variety of such caps as are well known to those of ordinary skill in the art. Preferably the container, particularly when filled with cyanoacrylate will have a cap having a dispensing tip to aid in directing the discharge of cyanoacrylate to the appropriate point of application.

Figure 2:
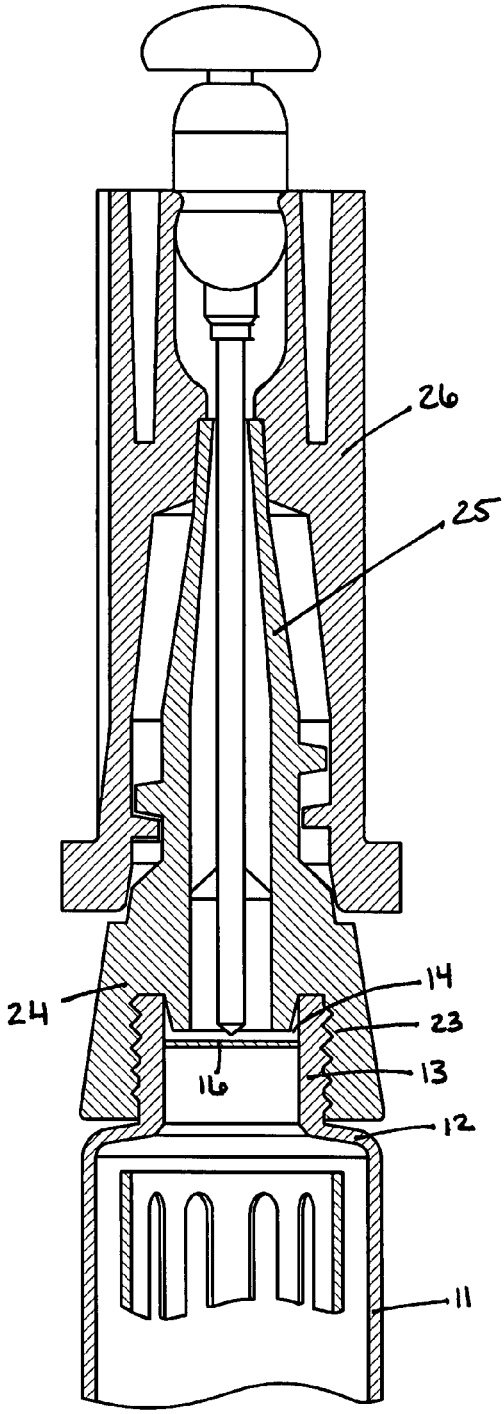
FIG. 2 is an expanded cross sectional view of the area identified as 2 in FIG. 1.
Figure 8:
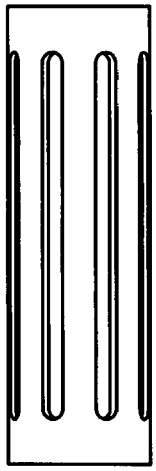
FIG. 8 is a plan view of the stiffener shown in FIGS. 1-3.
Figure 9:
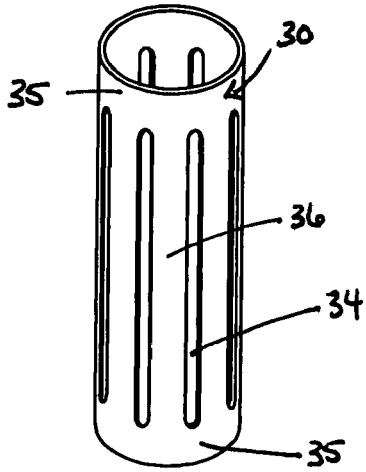
FIG. 9 is a perspective view of the stiffener of FIG. 8.
Figure 10:
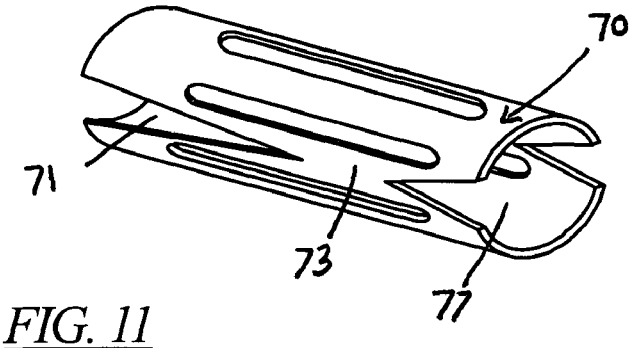
FIG. 10 is a perspective view of another embodiment of a stiffener.
Figure 11:
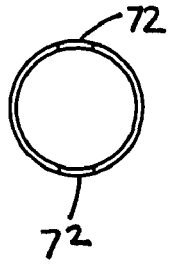
FIG. 11 is an end view of the stiffener of FIG. 10.
Figure 12:
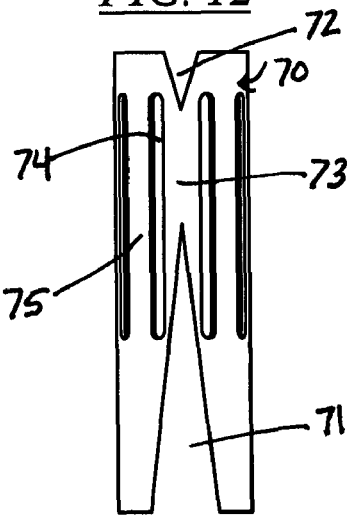
FIG. 12 is a plan view of the stiffener of FIG. 10.
Figure 13:
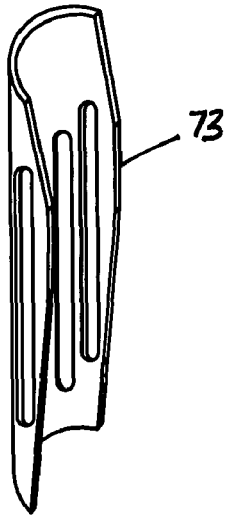
FIG. 13 is a perspective view of one-half of the stiffener of FIG. 10.
Figure 14:
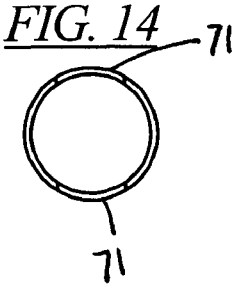
FIG. 14 is an end view of the end of the stiffener of FIG. 10 opposite the view of FIG. 11.

Positioned interior of the main body 11 is a resilient stiffener 30. The stiffener is formed of a plastics material impervious to the contents of the container and having a stiffness or resistance to compression greater than the material of the main body forming material. The stiffener illustrated in FIGS. 1-3 and again in FIGS. 8 and 9 will have a cross sectional shape generally complimentary to the cross sectional shape of the main body portion 11 of the container 10 and will be spaced from the interior wall 32 of the main body such that the outer wall 33 of the stiffener will define a stiffener exterior of smaller dimension than the dimension of the interior of the main body defined by the inner wall 32. Thus there can be a clearance between walls 33 and 32.

In the preferred embodiment the main body 11 is tubular and the stiffener is also formed as a tubular member such that the outer wall 33 defines the outer diameter of the stiffener and the inner wall 32 defines the inner diameter of the main body portion. The stiffener 30 also has an axial length which is preferably slightly less than the axial length of the main body portion 11 so that the stiffener 30 may "float" radially and axially within the interior of the main body portion when the main body portion 11 is at its normal full formed shape. The stiffener 30 is formed with a plurality of longitudinally extending slots 34 which extend between unslotted end portions 35 forming ribs 36 between the slots. The ribs, which extend between the end portions 35, are yieldable and resilient providing a generally spring-like function such that when the stiffener is compressed in a radial direction it will resume its original shape upon release of the compression force.

With the stiffener positioned interior of the container 10, and with the membrane 16 pierced, the contents of the container can be caused to flow through the nozzle 25 by applying compressive pressure to the main body portion, generally by squeezing it between the thumb and forefinger. Because the main body is formed of a soft formable metal, it will collapse into contact with the outer diameter of the stiffener. During that initial collapse material in the main body section can move from the gap area 40 between the inner diameter wall 32 and the outer diameter stiffener wall 33 by flowing through the slots 34 as needed. Further pressure will cause the ribs 36 to distort inwardly, and the material in the main body portion will be dispensed through the tip 25. Upon release of the pressure, the spring-like action of the ribs 36 will cause the stiffener to return to its original shape pushing upwardly against the inner wall 32 of the main body portion thereby expanding the squeezed in portion of the main body portion. This will cause a negative pressure to exist at the dispense end of the nozzle and will result in a "sniff back" of some of the contents in the dispensing nozzle. This is a highly desirable feature allowing for much greater accuracy in dispensing.

Because of the soft deformable nature of the container 10, the section pressed inwardly into contact with the stiffener will generally not return to its original shape but will retain substantially its generally tubular appearance as the gap 40 will generally be, as shown, a relatively small percentage of the diameter of the main body portion 10. A 90% stiffener diameter in comparison with the main body normal full inner diameter is acceptable but the gap may be larger or smaller.

Since dispensing is to be accomplished with the container inverted and the dispensing tip down, it will be seen that the entire contents of the container can be dispensed by the container which retains its general overall tubular shape by reason of the stiffener.

Figure 4:
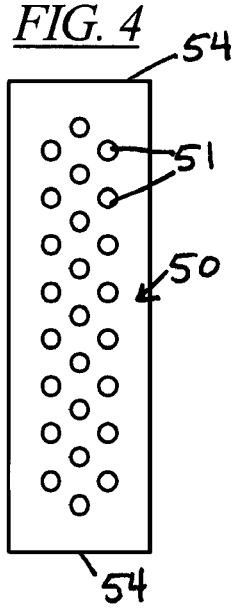
FIG. 4 is a plan view of an alternative stiffener.
Figure 5:
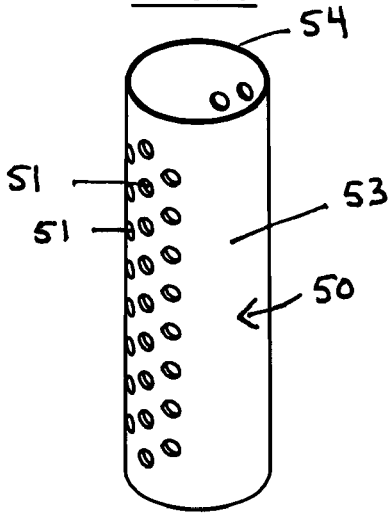
FIG. 5 is a perspective view of the stiffener of FIG. 4.

The slotted stiffener 30 illustrated in FIGS. 1-3, 8 and 9 is but one of many different configurations usable. For example, shown in FIG. 4 a stiffener 50 may be provided with a generally cylindrical tubular shape having a series of individual holes or openings 51 therethrough which are both longitudinally and circumferentially spaced from one another, the openings 51 may extend entirely around the circumference of the stiffener, or may extend only around a portion of the circumference leaving generally solid axial lengths 53 extending between the ends 54 of the stiffener.

Figure 6:
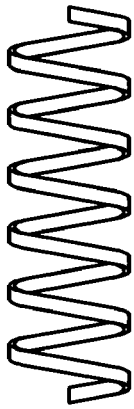
FIG. 6 is a plan view of another alternative stiffener.
Figure 7:
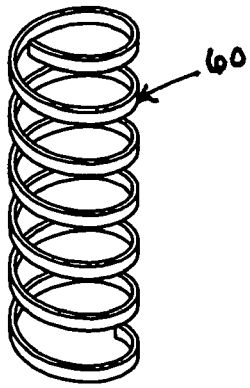
FIG. 7 is a perspective view of the stiffener of FIG. 6.

Another type of stiffener is shown in FIGS. 6 and 7 where the stiffener 60 is formed generally as a coil. Preferably the coil 60 is radially compressible and will have the same spring-like function as the ribs 36.

FIGS. 10-14 illustrate yet another type of stiffener 70, which may be formed with V-shaped cutouts 71 and 72 at opposite ends of the tubular stiffener, the V-shaped cutouts extending axially along the length of the stiffener leaving a central section 73 extending between the slots 71 and 72. Circumferentially of section 73 the stiffener may be slotted as at 74 providing ribs 75 similar to the ribs 36.

It will therefore be apparent to those skilled in the art that this invention may be practiced with resilient stiffeners of many different shapes and configurations. The stiffeners have an outer boundary less than the inner boundary of the as-formed soft metal container body so as the provide for a floating effect of the stiffener within the body originally until the body has been compressed into contact with the stiffener, at which point the stiffener will resist further distortion of the soft metal body, except under dispensing pressure.

In the preferred example utilizing a tubular container and a tubular stiffener, this requirement can be described as requiring that the outer diameter of the stiffener be less than the inner diameter of the as-formed container. The diameter difference may be greater or lesser as desired, but I prefer a range of between 85-95%. The less the stiffener diameter is with respect to the main body, the more collapsed look of the tube results. Preferably the stiffener is formed with openings between its interior and exterior to allow free flow of container material between the interior and exterior of the stiffener. The stiffener is open along its axial length and preferably has a length less than the full axial length of the main body portion of the container being defined as that portion between the neck reduction at the dispensing end and the dimensional reduction at the crimping end in the as-formed and crimped condition.

Although I have shown this invention in a preferred embodiment and alternative stiffener combinations, it will be readily apparent to those of ordinary skill in the art that others may wish to practice this invention in different configurations, utilizing different materials, different dimensions and different types of containers.

I claim as my invention:

1. A dispensing container for cyanoacrylate adhesives comprising: a soft metal container having a dispensing opening at one end and a crimped closure at an opposite end, the container defining a main body portion having an interior between the ends, a stiffener having a length formed of a more rigid material than the soft metal of the container received in the interior of the container, the stiffener having a hollow interior and an outer dimension defined by an outer wall, the outer dimension being less than an inner dimension of the main body portion of the container defined by an inner wall of the container whereby the stiffener in cross section is smaller than the main body of the container in cross section providing an at least partially circumferential space between the container inner dimension and the stiffener outer dimension such that the stiffener is free to float within the container main body when the container main body is in its as fully formed condition, and the container has been dosed with an adhesive, the adhesive filling at least some of the circumferential space between the outer dimension of the stiffener and the inner dimension of the container, the adhesive contacting both an inner surface and an outer surface of the stiffener when the container has been dosed, the stiffener having a plurality of openings between the hollow interior and an exterior of the stiffener providing a plurality of circumferentially spaced pathways extending for a majority of the length of the stiffener for adhesive to flow from the space to and from the stiffener interior, the stiffener being resilient and deformable under dispensing pressure applied to the wall of the container whereby the stiffener may resist collapse of the container while resiliently returning the collapsed container from a more collapsed position to a less collapsed position upon release of dispensing pressure.

2. A container according to claim 1 wherein the stiffener is substantially tubular and has a plurality of circumferentially spaced, longitudinally extending slots defining circumferentially spaced ribs between the slots, the ribs being attached to unslotted portions of the stiffener adjacent each end of the stiffener and the ribs acting as spring members.

3. A container according to claim 1 wherein the stiffener is a generally tubular body having a plurality of axially and circumferentially spaced openings extending through the wall of the stiffener from a hollow interior of the stiffener to the exterior wall of the stiffener.

4. A container according to claim 1 wherein the stiffener is a tubular coil member.

5. A container according to claim 1 wherein the stiffener is a generally tubular member having opposed V-shaped slots extending axially from the ends of the stiffener towards one another terminating spaced apart from one another.

6. A container according to claim 5 wherein the stiffener has a plurality of openings circumferentially spaced from the slots.

7. A container specifically adapted for use in dispensing cyanoacrylate adhesives comprising an aluminum alloy container body formed with a throat opening at one end and a crimped closure at a second end opposite the one end, the two ends being spaced apart by a main body portion defining a contents containing section, the main body portion having a hollow interior defined by a relatively thin walled deformable boundary wall, a stiffener received in the hollow interior of the main body portion, the stiffener being formed of a resilient plastics material having a rigidity greater than the aluminum alloy of the container at normal temperatures and being substantially impervious to cyanoacrylate, the stiffener having a hollow interior defined by an enclosing longitudinally extending wall, the wall having a maximum cross sectional dimension less than a cross sectional section of the hollow interior of the main body whereby the stiffener may float within the as-formed main body portion of the container, an at least partially circumferentially extending space provided in the content's containing section in an area between the maximum cross sectional dimension of the stiffener and the cross sectional section of the hallow interior of the main body, the space forming a part of the content's containing section, both an inner surface of the stiffener and an outer surface of the stiffener being in physical contact with the contents in the location of the space when the container is dosed with contents, the stiffener at least one wall opening therethrough between its interior and exterior extending axially from each end of the stiffener, the wall openings providing a pathway between the space and the interior of the stiffener to allow contents to flow between the space and the interior and the interior and the space.

8. The container of claim 7 wherein the opening is a circumferentially spiral opening.

* * * * *